US009010344B2

(12) United States Patent
Tuller et al.

(10) Patent No.: US 9,010,344 B2
(45) Date of Patent: Apr. 21, 2015

(54) ROTATING FILTER FOR A DISHWASHING MACHINE

(75) Inventors: Barry E. Tuller, Stevensville, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 933 days.

(21) Appl. No.: 13/164,501

(22) Filed: Jun. 20, 2011

(65) Prior Publication Data

US 2012/0318309 A1 Dec. 20, 2012

(51) Int. Cl.
*A47L 15/42* (2006.01)
*B01D 29/64* (2006.01)

(52) U.S. Cl.
CPC ..... *A47L 15/4208* (2013.01); *A47L 15/4206* (2013.01); *A47L 15/4219* (2013.01); *A47L 15/4225* (2013.01)

(58) Field of Classification Search
CPC ..... A47L 15/4206; A47L 15/4208; B01D 29/6476
USPC ..... 134/56 D, 57 D, 58 D, 110
See application file for complete search history.

(56) References Cited

U.S. PATENT DOCUMENTS

| | | | |
|---|---|---|---|
| 1,617,021 | A | 2/1927 | Mitchell |
| 2,154,559 | A | 4/1939 | Bilde |
| 2,422,022 | A | 6/1947 | Koertge |
| 2,734,122 | A | 2/1956 | Flannery |
| 3,016,147 | A | 1/1962 | Cobb et al. |
| 3,026,628 | A | 3/1962 | Berger, Sr. et al. |
| 3,068,877 | A | 12/1962 | Jacobs |
| 3,103,227 | A | 9/1963 | Long |
| 3,122,148 | A | 2/1964 | Alabaster |
| 3,186,417 | A | 6/1965 | Fay |
| 3,288,154 | A | 11/1966 | Jacobs |
| 3,542,594 | A | 11/1970 | Smith et al. |
| 3,575,185 | A | 4/1971 | Barbulesco |
| 3,586,011 | A | 6/1971 | Mazza |
| 3,739,145 | A | 6/1973 | Woehler |
| 3,801,280 | A | 4/1974 | Shah et al. |
| 3,846,321 | A | 11/1974 | Strange |
| 3,906,967 | A | 9/1975 | Bergeson |
| 3,989,054 | A | 11/1976 | Mercer |
| 4,179,307 | A | 12/1979 | Cau et al. |

(Continued)

FOREIGN PATENT DOCUMENTS

| | | |
|---|---|---|
| CH | 169630 | 6/1934 |
| CN | 2571812 | 9/2003 |

(Continued)

OTHER PUBLICATIONS

Kaefferlein, Heinz, "DE4131914A1 English Machine Translation.pdf", Apr. 1, 1993—Machine translation from Espacenet.com.*

(Continued)

*Primary Examiner* — Joseph L Perrin
*Assistant Examiner* — Levon J Shahinian

(57) ABSTRACT

A dishwasher with a tub at least partially defining a treating chamber, a liquid spraying system, a liquid recirculation system defining a recirculation flow path, and a liquid filtering system. The liquid filtering system includes a rotating filter disposed in the recirculation flow path to filter the liquid.

23 Claims, 12 Drawing Sheets

(56) References Cited

U.S. PATENT DOCUMENTS

| | | | |
|---|---|---|---|
| 4,180,095 | A | 12/1979 | Woolley et al. |
| 4,326,552 | A | 4/1982 | Bleckmann |
| 4,754,770 | A | 7/1988 | Fornasari |
| 5,002,890 | A | 3/1991 | Morrison |
| 5,030,357 | A | 7/1991 | Lowe |
| 5,133,863 | A | 7/1992 | Zander |
| 5,331,986 | A | 7/1994 | Lim et al. |
| 5,454,298 | A | 10/1995 | Lu |
| 5,470,142 | A | 11/1995 | Sargeant et al. |
| 5,470,472 | A | 11/1995 | Baird et al. |
| 5,557,704 | A | 9/1996 | Dennis et al. |
| 5,569,383 | A | 10/1996 | Vander Ark, Jr. et al. |
| 5,618,424 | A | 4/1997 | Nagaoka |
| 5,711,325 | A | 1/1998 | Kloss et al. |
| 5,755,244 | A | 5/1998 | Sargeant et al. |
| 5,782,112 | A | 7/1998 | White et al. |
| 5,803,100 | A | 9/1998 | Thies |
| 5,865,997 | A | 2/1999 | Isaacs |
| 5,868,937 | A | 2/1999 | Back et al. |
| 5,904,163 | A | 5/1999 | Inoue et al. |
| 5,924,432 | A | 7/1999 | Thies et al. |
| 6,289,908 | B1 | 9/2001 | Kelsey |
| 6,389,908 | B1 | 5/2002 | Chevalier et al. |
| 6,460,555 | B1 | 10/2002 | Tuller et al. |
| 6,491,049 | B1 | 12/2002 | Tuller et al. |
| 6,601,593 | B2 | 8/2003 | Deiss et al. |
| 6,666,976 | B2 | 12/2003 | Benenson, Jr. et al. |
| 6,800,197 | B1 | 10/2004 | Kosola et al. |
| 6,997,195 | B2 | 2/2006 | Durazzani et al. |
| 7,047,986 | B2 | 5/2006 | Ertle et al. |
| 7,069,181 | B2 | 6/2006 | Jerg et al. |
| 7,093,604 | B2 | 8/2006 | Jung et al. |
| 7,150,284 | B2 | 12/2006 | Aulbers et al. |
| 7,153,817 | B2 | 12/2006 | Binder |
| 7,198,054 | B2 | 4/2007 | Welch |
| 7,208,080 | B2 | 4/2007 | Batten et al. |
| 7,232,494 | B2 | 6/2007 | Rappette |
| 7,250,174 | B2 | 7/2007 | Lee et al. |
| 7,270,132 | B2 | 9/2007 | Inui et al. |
| 7,319,841 | B2 | 1/2008 | Bateman, III et al. |
| 7,326,338 | B2 | 2/2008 | Batten et al. |
| 7,347,212 | B2 | 3/2008 | Rosenbauer |
| 7,350,527 | B2 | 4/2008 | Gurubatham et al. |
| 7,363,093 | B2 | 4/2008 | King et al. |
| 7,406,843 | B2 | 8/2008 | Thies et al. |
| 7,445,013 | B2 | 11/2008 | VanderRoest et al. |
| 7,497,222 | B2 | 3/2009 | Edwards et al. |
| 7,523,758 | B2 | 4/2009 | VanderRoest et al. |
| 7,594,513 | B2 | 9/2009 | VanderRoest et al. |
| 7,819,983 | B2 | 10/2010 | Kim et al. |
| 7,896,977 | B2 | 3/2011 | Gillum et al. |
| 8,043,437 | B1 | 10/2011 | Delgado et al. |
| 8,161,986 | B2 | 4/2012 | Allessandrelli |
| 8,215,322 | B2 | 7/2012 | Fountain et al. |
| 8,667,974 | B2 | 3/2014 | Fountain et al. |
| 8,746,261 | B2 | 6/2014 | Welch |
| 2002/0017483 | A1 | 2/2002 | Chesner et al. |
| 2003/0037809 | A1 | 2/2003 | Favaro |
| 2003/0205248 | A1* | 11/2003 | Christman et al. ..... 134/22.18 |
| 2004/0007253 | A1 | 1/2004 | Jung et al. |
| 2004/0103926 | A1 | 6/2004 | Ha |
| 2005/0022849 | A1 | 2/2005 | Park et al. |
| 2005/0133070 | A1 | 6/2005 | Vanderroest et al. |
| 2006/0005863 | A1 | 1/2006 | Gurubatham et al. |
| 2006/0123563 | A1 | 6/2006 | Raney et al. |
| 2006/0162744 | A1 | 7/2006 | Walkden |
| 2006/0174915 | A1 | 8/2006 | Hedstrom et al. |
| 2006/0236556 | A1 | 10/2006 | Ferguson et al. |
| 2006/0237049 | A1 | 10/2006 | Weaver et al. |
| 2007/0006898 | A1 | 1/2007 | Lee |
| 2007/0107753 | A1 | 5/2007 | Jerg |
| 2007/0163626 | A1 | 7/2007 | Klein |
| 2007/0186964 | A1 | 8/2007 | Mason et al. |
| 2007/0246078 | A1 | 10/2007 | Purtilo et al. |
| 2007/0266587 | A1 | 11/2007 | Bringewatt et al. |
| 2008/0116135 | A1 | 5/2008 | Rieger et al. |
| 2008/0289654 | A1 | 11/2008 | Kim et al. |
| 2008/0289664 | A1 | 11/2008 | Rockwell et al. |
| 2009/0095330 | A1 | 4/2009 | Iwanaga et al. |
| 2009/0283111 | A1 | 11/2009 | Classen et al. |
| 2010/0012159 | A1 | 1/2010 | Verma et al. |
| 2010/0043826 | A1 | 2/2010 | Bertsch et al. |
| 2010/0043847 | A1 | 2/2010 | Yoon et al. |
| 2010/0121497 | A1 | 5/2010 | Heisele et al. |
| 2010/0154830 | A1 | 6/2010 | Lau et al. |
| 2010/0154841 | A1 | 6/2010 | Fountain et al. |
| 2010/0224223 | A1 | 9/2010 | Kehl et al. |
| 2010/0252081 | A1 | 10/2010 | Classen et al. |
| 2010/0300499 | A1 | 12/2010 | Han et al. |
| 2011/0061682 | A1 | 3/2011 | Fountain et al. |
| 2011/0120508 | A1 | 5/2011 | Yoon et al. |
| 2011/0146714 | A1 | 6/2011 | Fountain et al. |
| 2011/0146730 | A1 | 6/2011 | Welch |
| 2011/0146731 | A1 | 6/2011 | Fountain et al. |
| 2012/0097200 | A1 | 4/2012 | Fountain |
| 2012/0118330 | A1 | 5/2012 | Tuller et al. |
| 2012/0118336 | A1 | 5/2012 | Welch |
| 2012/0138096 | A1 | 6/2012 | Tuller et al. |
| 2012/0138106 | A1 | 6/2012 | Fountain et al. |
| 2012/0138107 | A1 | 6/2012 | Fountain et al. |
| 2012/0291805 | A1 | 11/2012 | Tuller et al. |
| 2012/0291822 | A1 | 11/2012 | Tuller et al. |
| 2012/0318295 | A1 | 12/2012 | Delgado et al. |
| 2012/0318296 | A1 | 12/2012 | Fountain et al. |
| 2012/0318308 | A1 | 12/2012 | Fountain et al. |

FOREIGN PATENT DOCUMENTS

| | | | |
|---|---|---|---|
| CN | 2761660 | | 3/2006 |
| CN | 1966129 | | 5/2007 |
| CN | 2907830 | | 6/2007 |
| CN | 101406379 | | 4/2009 |
| CN | 201276653 | | 7/2009 |
| CN | 201361486 | | 12/2009 |
| CN | 101654855 | | 2/2010 |
| CN | 201410325 | | 2/2010 |
| CN | 201473770 | | 5/2010 |
| DE | 1134489 | | 8/1961 |
| DE | 1428358 | A1 | 11/1968 |
| DE | 1453070 | | 3/1969 |
| DE | 7105474 | | 8/1971 |
| DE | 7237309 | U | 9/1973 |
| DE | 2825242 | A1 | 1/1979 |
| DE | 3337369 | A1 | 4/1985 |
| DE | 3723721 | A1 | 5/1988 |
| DE | 3842997 | A1 | 7/1990 |
| DE | 4011834 | | 10/1991 |
| DE | 4016915 | A1 | 11/1991 |
| DE | 4131914 | A1 | 4/1993 |
| DE | 4236931 | A1 | 5/1993 |
| DE | 9415486 | U1 | 11/1994 |
| DE | 9416710 | U1 | 1/1995 |
| DE | 4413432 | C1 | 8/1995 |
| DE | 4418523 | A1 | 11/1995 |
| DE | 4433842 | | 3/1996 |
| DE | 69111365 | T2 | 3/1996 |
| DE | 19546965 | A1 | 6/1997 |
| DE | 69403957 | T2 | 1/1998 |
| DE | 19652235 | | 6/1998 |
| DE | 10000772 | A1 | 7/2000 |
| DE | 69605965 | T2 | 8/2000 |
| DE | 19951838 | A1 | 5/2001 |
| DE | 10065571 | A1 | 7/2002 |
| DE | 10106514 | A1 | 8/2002 |
| DE | 60206490 | T2 | 5/2006 |
| DE | 60302143 | | 8/2006 |
| DE | 102005023428 | A1 | 11/2006 |
| DE | 102005038433 | A1 | 2/2007 |
| DE | 102007007133 | A1 | 8/2008 |
| DE | 102007060195 | A1 | 6/2009 |
| DE | 202010006739 | U1 | 8/2010 |
| DE | 102009027910 | A1 | 1/2011 |
| DE | 102009028278 | A1 | 2/2011 |
| DE | 102010061215 | | 6/2011 |

(56) References Cited

FOREIGN PATENT DOCUMENTS

| | | | |
|---|---|---|---|
| DE | 102011052846 | A1 | 5/2012 |
| DE | 102012103435 | A1 | 12/2012 |
| EP | 0068974 | A1 | 1/1983 |
| EP | 0178202 | A1 | 4/1986 |
| EP | 0198496 | A1 | 10/1986 |
| EP | 0208900 | A2 | 1/1987 |
| EP | 0370552 | A1 | 5/1990 |
| EP | 0374616 | A1 | 6/1990 |
| EP | 0383028 | A2 | 8/1990 |
| EP | 0405627 | A1 | 1/1991 |
| EP | 437189 | A1 | 7/1991 |
| EP | 0454640 | A1 | 10/1991 |
| EP | 0521815 | A1 | 1/1993 |
| EP | 0585905 | A2 | 9/1993 |
| EP | 0702928 | A1 | 8/1995 |
| EP | 0597907 | B1 | 12/1995 |
| EP | 0725182 | A1 | 8/1996 |
| EP | 0748607 | A2 | 12/1996 |
| EP | 752231 | A1 | 1/1997 |
| EP | 0752231 | A1 | 1/1997 |
| EP | 0854311 | A2 | 7/1998 |
| EP | 0855165 | A2 | 7/1998 |
| EP | 0898928 | A1 | 3/1999 |
| EP | 1029965 | A1 | 8/2000 |
| EP | 1224902 | A2 | 7/2002 |
| EP | 1256308 | A2 | 11/2002 |
| EP | 1264570 | | 12/2002 |
| EP | 1319360 | A1 | 6/2003 |
| EP | 1342827 | | 9/2003 |
| EP | 1346680 | A2 | 9/2003 |
| EP | 1386575 | A1 | 2/2004 |
| EP | 1415587 | | 5/2004 |
| EP | 1498065 | A1 | 1/2005 |
| EP | 1583455 | A1 | 10/2005 |
| EP | 1703834 | A1 | 9/2006 |
| EP | 1728913 | A2 | 12/2006 |
| EP | 1743871 | A1 | 1/2007 |
| EP | 1862104 | A1 | 12/2007 |
| EP | 1882436 | A1 | 1/2008 |
| EP | 1980193 | A1 | 10/2008 |
| EP | 2127587 | A1 | 2/2009 |
| EP | 2075366 | A1 | 7/2009 |
| EP | 2138087 | A1 | 12/2009 |
| EP | 2332457 | A1 | 6/2011 |
| EP | 2335547 | | 6/2011 |
| EP | 2338400 | | 6/2011 |
| EP | 2351507 | | 8/2011 |
| FR | 1370521 | A | 8/1964 |
| FR | 2372363 | A1 | 6/1978 |
| FR | 2491320 | A1 | 4/1982 |
| FR | 2491321 | A1 | 4/1982 |
| FR | 2790013 | A1 | 8/2000 |
| GB | 973859 | A | 10/1964 |
| GB | 1047948 | | 11/1966 |
| GB | 1123789 | A | 8/1968 |
| GB | 1515095 | | 6/1978 |
| GB | 2274772 | A | 8/1994 |
| JP | 55039215 | A | 3/1980 |
| JP | 60069375 | A | 4/1985 |
| JP | 61085991 | A | 5/1986 |
| JP | 61200824 | | 9/1986 |
| JP | 61200824 | A | 9/1986 |
| JP | 1005521 | A | 1/1989 |
| JP | 1080331 | A | 3/1989 |
| JP | 5245094 | A | 9/1993 |
| JP | 07178030 | | 7/1995 |
| JP | 10109007 | A | 4/1998 |
| JP | 2000107114 | A | 4/2000 |
| JP | 2001190479 | A | 7/2001 |
| JP | 2001190480 | A | 7/2001 |
| JP | 2003336909 | A | 12/2003 |
| JP | 2003339607 | A | 12/2003 |
| JP | 2004267507 | A | 9/2004 |
| JP | 2005124979 | A | 5/2005 |
| JP | 2006075635 | A | 3/2006 |
| JP | 2007068601 | A | 3/2007 |
| JP | 2008093196 | A | 4/2008 |
| JP | 2008253543 | A | 10/2008 |
| JP | 2008264018 | A | 11/2008 |
| JP | 2008264724 | A | 11/2008 |
| JP | 2010035745 | A | 2/2010 |
| JP | 2010187796 | A | 9/2010 |
| KR | 20010077128 | | 8/2001 |
| KR | 20090006659 | | 1/2009 |
| KR | 20090061479 | A | 6/2009 |
| KR | 20100037453 | A | 4/2010 |
| WO | 2005058124 | A1 | 6/2005 |
| WO | 2005115216 | A1 | 12/2005 |
| WO | 2007024491 | A2 | 3/2007 |
| WO | 2007074024 | A1 | 7/2007 |
| WO | 2008067898 | A1 | 6/2008 |
| WO | 2008125482 | | 10/2008 |
| WO | 2009018903 | A1 | 2/2009 |
| WO | 2009065696 | A1 | 5/2009 |
| WO | 2009077266 | A1 | 6/2009 |
| WO | 2009077279 | A2 | 6/2009 |
| WO | 2009077280 | A1 | 6/2009 |
| WO | 2009077283 | A1 | 6/2009 |
| WO | 2009077286 | A1 | 6/2009 |
| WO | 2009077290 | A1 | 6/2009 |
| WO | 2009118308 | A1 | 10/2009 |

OTHER PUBLICATIONS

European Search Report for Corresponding EP 12191467.5, Dec. 5, 2012.
European Search Report for EP11188106, Mar. 29, 2012.
German Search Report for Counterpart DE102013109125, Dec. 9, 2013.
German Search Report for DE102011053666, Oct. 21, 2011.
German Search Report for DE102010061347, Jan. 23, 2013.
German Search Report for DE102010061215, Feb. 7, 2013.
German Search Report for DE102010061346, Sep. 30, 2011.
German Search Report for DE102010061343, Jul. 7, 2011.
German Search Report for DE102010061342, Aug. 19, 2011.
European Search Report for EP101952380, May 19, 2011.
European Search Report for EP12188007, Aug. 6, 2013.
German Search Report for DE102013103264, Jul. 12, 2013.
German Search Report for DE102013103625, Jul. 19, 2013.
Ishihara et al., JP 11155792 A, English Machine Translation, 1999, pp. 1-14.
German Search Report for Counterpart DE102014101260.7, Sep. 18, 2014.

* cited by examiner

ROTATING FILTER FOR A DISHWASHING MACHINE

BACKGROUND OF THE INVENTION

A dishwashing machine is a domestic appliance into which dishes and other cooking and eating wares (e.g., plates, bowls, glasses, flatware, pots, pans, bowls, etc.) are placed to be washed. A dishwashing machine includes various filters to separate soil particles from wash liquid during the recirculation of the sprayed wash liquid.

SUMMARY OF THE INVENTION

The invention relates to a dishwasher with a liquid spraying system, a liquid recirculation system, and a liquid filtering system. The liquid filtering system includes a liquid filtering system fluidly coupled to the recirculation flow path and comprising, a rotating filter having first and second ends and a downstream surface and an upstream surface and located within the recirculation flow path such that the sprayed liquid passes through the filter from the upstream surface to downstream surface to effect a filtering of the sprayed liquid, and a first artificial boundary overlying and spaced from at least a portion of the upstream surface to form an increased shear force zone therebetween to apply a greater shear force on the upstream surface than liquid in an absence of the first artificial boundary, and having a surface oriented at an angle relative to the central axis to deflect soils near the upstream surface toward the one of the first and second ends, wherein rotation of the filter while liquid is passing through along the recirculation flow path results in soils residing near the upstream surface and the soils are directed toward the one of the first and second ends where the soils accumulate.

DESCRIPTION OF EMBODIMENTS OF THE INVENTION

Figure 1:
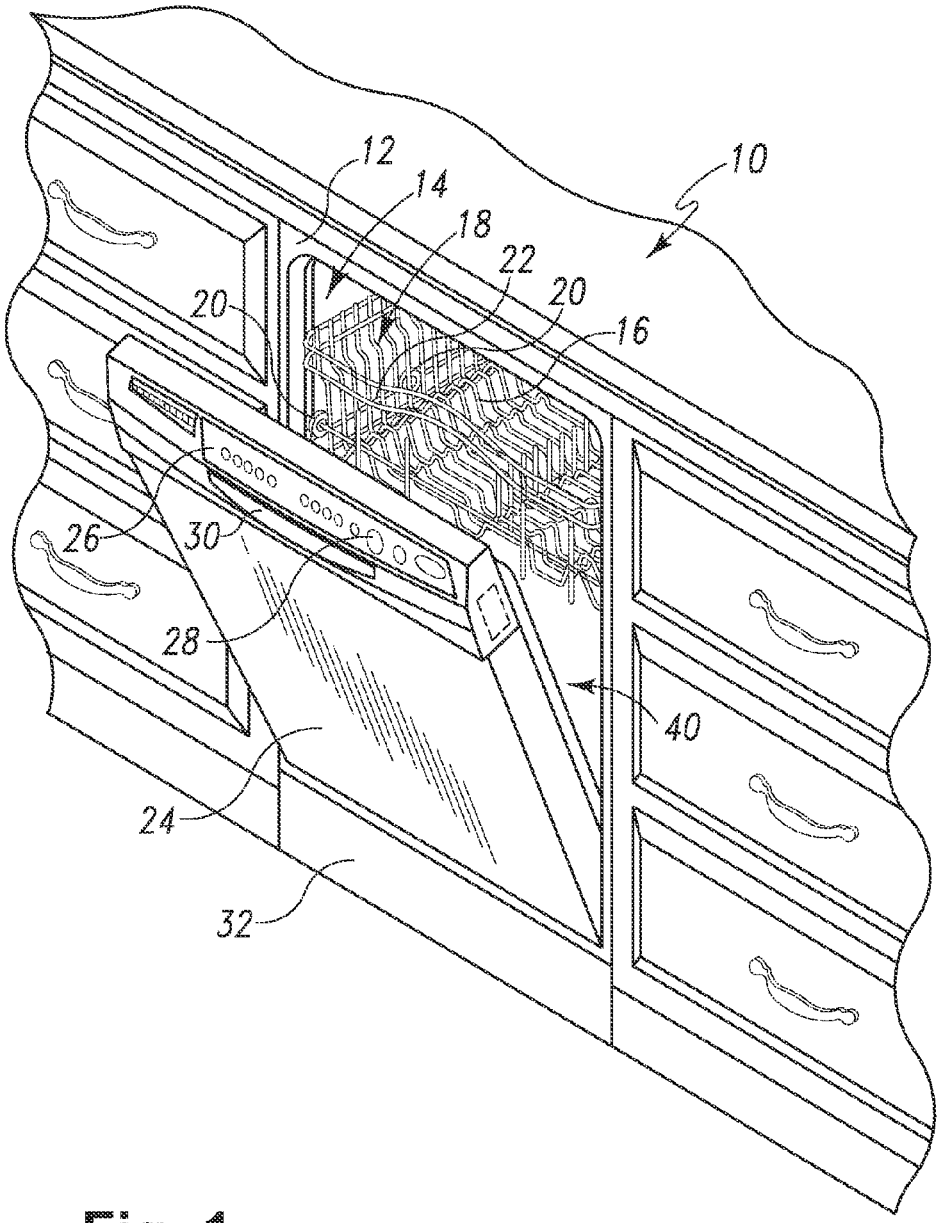
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims. For example, while the present invention is described in terms of a conventional dishwashing unit, it could also be implemented in other types of dishwashing units, such as in-sink dishwashers or drawer-type dishwashers.

Referring to FIG. 1, a dishwashing machine 10 (hereinafter dishwasher 10) is shown. The dishwasher 10 has a tub 12 that at least partially defines a treating chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish racks 16 and the tub 12. The roller assemblies 18 allow the dish racks 16 to extend from and retract into the tub 12, which facilitates the loading and unloading of the dish racks 16. The roller assemblies 18 include a number of rollers 20 that move along a corresponding support rail 22.

A door 24 is hinged to the lower front edge of the tub 12. The door 24 permits user access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, which are used by a controller (not shown) to control the operation of the dishwasher 10. A handle 30 is also included in the control panel 26. The user may use the handle 30 to unlatch and open the door 24 to access the tub 12.

Figure 2:
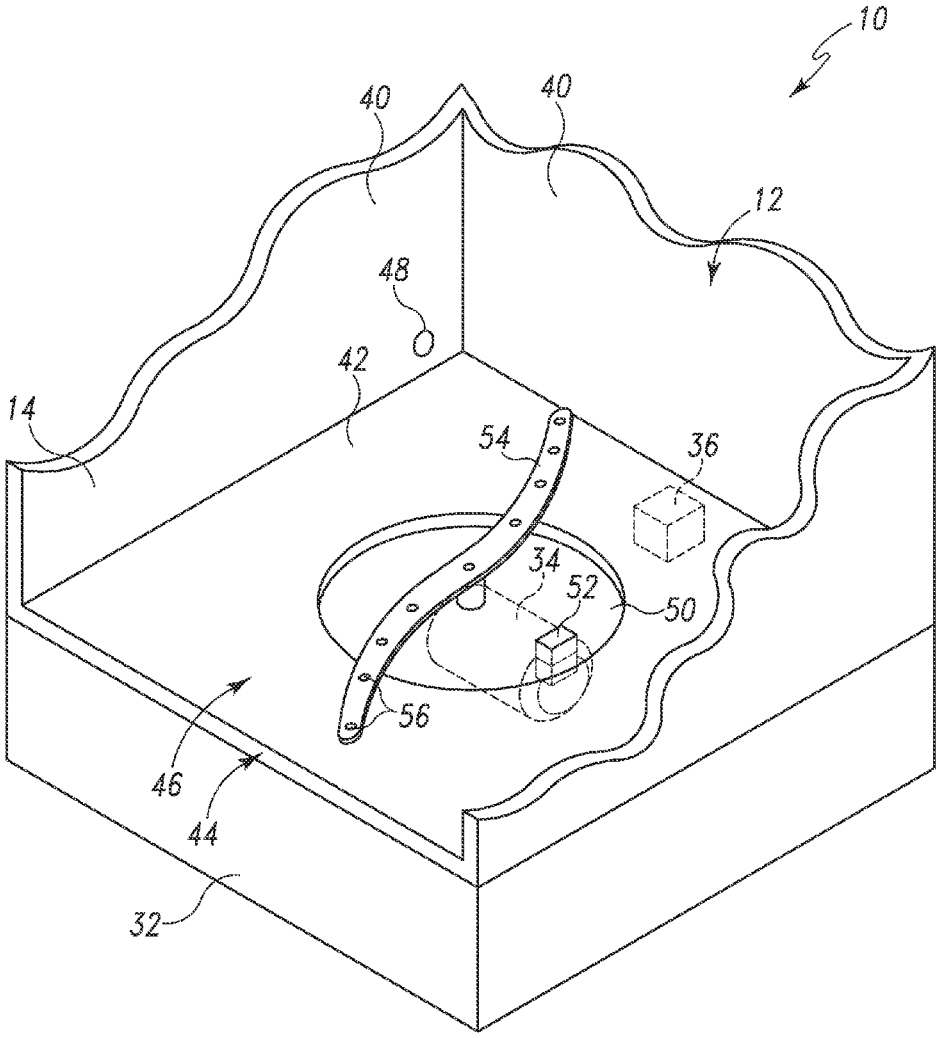
FIG. 2 is a fragmentary perspective view of the tub of the dishwashing machine of FIG. 1.

A machine compartment 32 is located below the tub 12. The machine compartment 32 is sealed from the tub 12. In other words, unlike the tub 12, which is filled with liquid and exposed to spray during the wash cycle, the machine compartment 32 does not fill with liquid and is not exposed to spray during the operation of the dishwasher 10. Referring now to FIG. 2, the machine compartment 32 houses a recirculation pump assembly 34 and the drain pump 36, as well as the dishwasher's other motor(s) and valve(s), along with the associated wiring and plumbing. The recirculation pump 36 and associated wiring and plumbing form a liquid recirculation system.

Referring now to FIG. 2, the tub 12 of the dishwasher 10 is shown in greater detail. The tub 12 includes a number of side walls 40 extending upwardly from a bottom wall 42 to define the treating chamber 14. The open front side 44 of the tub 12 defines an access opening 46 of the dishwasher 10. The access opening 46 provides the user with access to the dish racks 16 positioned in the treating chamber 14 when the door 24 is open. When closed, the door 24 seals the access opening 46, which prevents the user from accessing the dish racks 16. The door 24 also prevents liquid from escaping through the access opening 46 of the dishwasher 10 during a wash cycle.

The bottom wall 42 of the tub 12 has a sump 50 positioned therein. At the start of a wash cycle, liquid enters the tub 12 through a hole 48 defined in the side wall 40. The sloped configuration of the bottom wall 42 directs liquid into the sump 50. The recirculation pump assembly 34 removes such water and/or wash chemistry from the sump 50 through a hole 52 defined in the bottom of the sump 50 after the sump 50 is partially filled with liquid.

The liquid recirculation system supplies liquid to a liquid spraying system, which includes a spray arm 54, to recirculate the sprayed liquid in the tub 12. The recirculation pump assembly 34 is fluidly coupled to a rotating spray arm 54 that sprays water and/or wash chemistry onto the dish racks 16 (and hence any wares positioned thereon) to effect a recirculation of the liquid from the treating chamber 14 to the liquid spraying system to define a recirculation flow path. Additional rotating spray arms (not shown) are positioned above the spray arm 54. It should also be appreciated that the dishwashing machine 10 may include other spray arms positioned at various locations in the tub 12. As shown in FIG. 2, the spray arm 54 has a number of nozzles 56. Liquid passes from the recirculation pump assembly 34 into the spray arm 54 and then exits the spray arm 54 through the nozzles 56. In the illustrative embodiment described herein, the nozzles 56 are embodied simply as holes formed in the spray arm 54. However, it is within the scope of the disclosure for the nozzles 56 to include inserts such as tips or other similar structures that are placed into the holes formed in the spray arm 54. Such inserts may be useful in configuring the spray direction or spray pattern of the liquid expelled from the spray arm 54.

After wash liquid contacts the dish racks 16, and any wares positioned in the treating chamber 14, a mixture of liquid and soil falls onto the bottom wall 42 and collects in the sump 50. The recirculation pump assembly 34 draws the mixture out of the sump 50 through the hole 52. As will be discussed in detail below, liquid is filtered in the recirculation pump assembly 34 and re-circulated onto the dish racks 16. At the conclusion of the wash cycle, the drain pump 36 removes both wash liquid and soil particles from the sump 50 and the tub 12.

Figure 3:
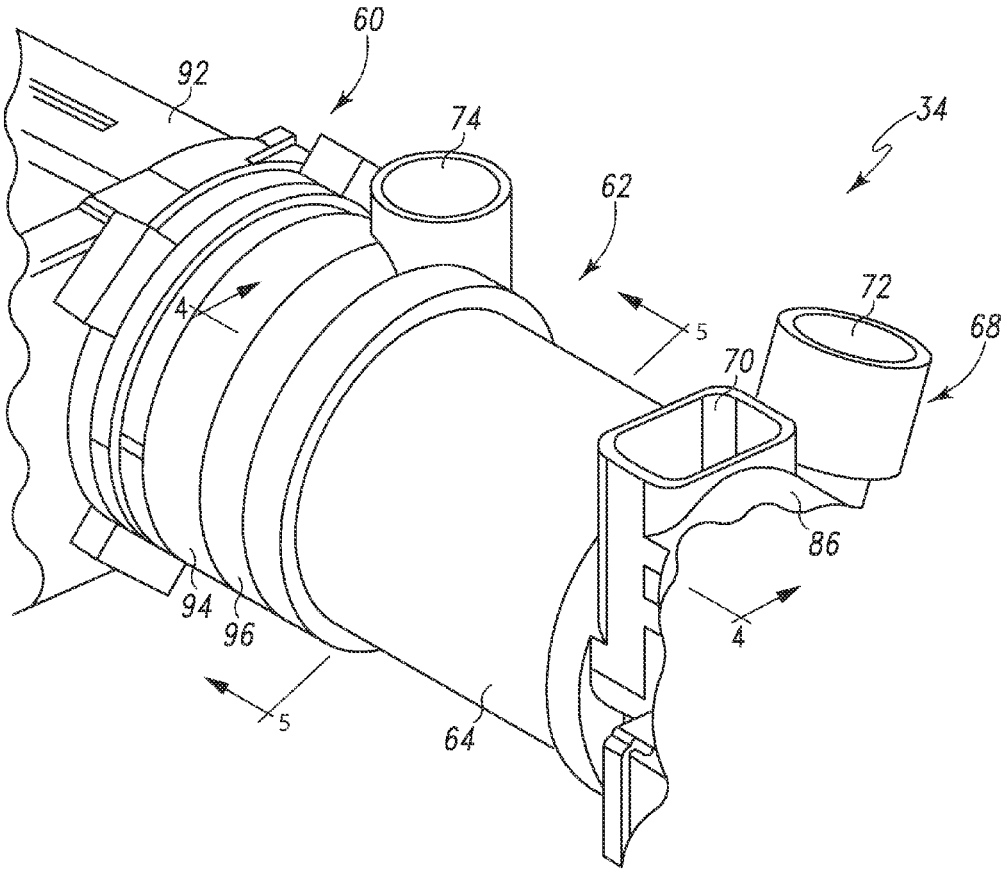
FIG. 3 is a perspective view of an embodiment of a pump and filter assembly for the dishwashing machine of FIG. 1.

Referring now to FIG. 3, the recirculation pump assembly 34 is shown removed from the dishwasher 10. The recirculation pump assembly 34 includes a wash pump 60 that is secured to a housing 62. The housing 62 includes cylindrical filter casing 64 positioned between a manifold 68 and the wash pump 60. The cylindrical filter casing 64 provides a liquid filtering system. The manifold 68 has an inlet port 70, which is fluidly coupled to the hole 52 defined in the sump 50, and an outlet port 72, which is fluidly coupled to the drain pump 36. Another outlet port 74 extends upwardly from the wash pump 60 and is fluidly coupled to the rotating spray arm 54. While recirculation pump assembly 34 is included in the dishwasher 10, it will be appreciated that in other embodiments, the recirculation pump assembly 34 may be a device separate from the dishwasher 10. For example, the recirculation pump assembly 34 might be positioned in a cabinet adjacent to the dishwasher 10. In such embodiments, a number of liquid hoses may be used to connect the recirculation pump assembly 34 to the dishwasher 10.

Figure 4:
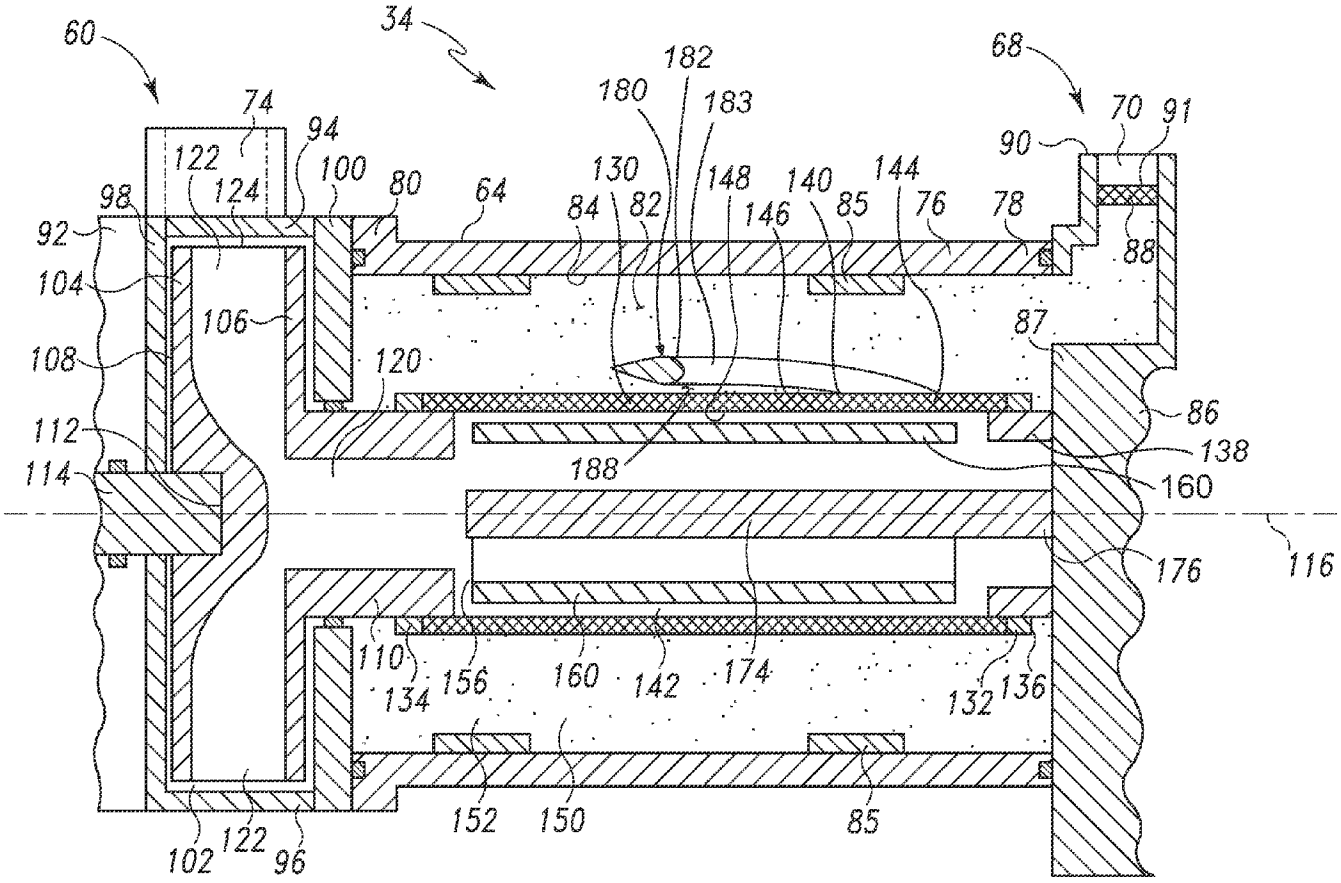
FIG. 4 is a cross-sectional view of the pump and filter assembly of FIG. 3 taken along the line 4-4 shown in FIG. 3.

Referring now to FIG. 4, a cross-sectional view of the recirculation pump assembly 34 is shown. The filter casing 64 is a hollow cylinder having a side wall 76 that extends from an end 78 secured to the manifold 68 to an opposite end 80 secured to the wash pump 60. The side wall 76 defines an interior or filter chamber 82 that extends the length of the filter casing 64. The housing 62, which defines the filter chamber 82, may be physically remote from the tub 12 such that the filter chamber 82 may form a sump that is also remote from the tub 12.

The side wall 76 has an inner surface 84 facing the filter chamber 82. A number of rectangular ribs 85 extend from the inner surface 84 into the filter chamber 82. The ribs 85 are configured to create drag to counteract the movement of liquid within the filter chamber 82. It should be appreciated that in other embodiments, each of the ribs 85 may take the form of a wedge, cylinder, pyramid, or other shape configured to create drag to counteract the movement of liquid within the filter chamber 82.

The manifold 68 has a main body 86 that is secured to the end 78 of the filter casing 64. The inlet port 70 extends upwardly from the main body 86 and is configured to be coupled to a liquid hose (not shown) extending from the hole 52 defined in the sump 50. The inlet port 70 opens through a sidewall 87 of the main body 86 into the filter chamber 82 of the filter casing 64. As such, during the wash cycle, a mixture of liquid and soil particles advances from the sump 50 into the filter chamber 82 and fills the filter chamber 82. As shown in FIG. 4, the inlet port 70 has a filter screen 88 positioned at an upper end 90. The filter screen 88 has a plurality of holes 91 extending there through. Each of the holes 91 is sized such that large soil particles are prevented from advancing into the filter chamber 82.

A passageway (not shown) places the outlet port 72 of the manifold 68 in fluid communication with the filter chamber 82. When the drain pump 36 is energized, liquid and soil particles from the sump 50 pass downwardly through the inlet port 70 into the filter chamber 82. Liquid then advances from the filter chamber 82 through the passageway and out the outlet port 72.

The wash pump 60 is secured at the opposite end 80 of the filter casing 64. The wash pump 60 includes a motor 92 (see FIG. 3) secured to a cylindrical pump housing 94. The pump housing 94 includes a side wall 96 extending from a base wall 98 to an end wall 100. The base wall 98 is secured to the motor 92 while the end wall 100 is secured to the end 80 of the filter casing 64. The walls 96, 98, 100 define an impeller chamber 102 that fills with liquid during the wash cycle. As shown in FIG. 4, the outlet port 74 is coupled to the side wall 96 of the pump housing 94 and opens into the chamber 102. The outlet port 74 is configured to receive a liquid hose (not shown) such that the outlet port 74 may be fluidly coupled to the spray arm 54.

The wash pump 60 also includes an impeller 104. The impeller 104 has a shell 106 that extends from a back end 108 to a front end 110. The back end 108 of the shell 106 is positioned in the chamber 102 and has a bore 112 formed therein. A drive shaft 114, which is rotatably coupled to the motor 92, is received in the bore 112. The motor 92 acts on the drive shaft 114 to rotate the impeller 104 about an imaginary axis 116 in a counter-clockwise direction. In this case, the axis 116 is a central axis of the filter 130. The central axis 116 may be oriented vertically or non-vertically and as illustrated, the central axis is oriented substantially horizontally. The motor 92 is connected to a power supply (not shown), which provides the electric current necessary for the motor 92 to spin the drive shaft 114 and rotate the impeller 104. In the illustrative embodiment, the motor 92 is configured to rotate the impeller 104 about the axis 116 at 3200 rpm.

The front end 110 of the impeller shell 106 is positioned in the filter chamber 82 of the filter casing 64 and has an inlet opening 120 formed in the center thereof. The shell 106 has a number of vanes 122 that extend away from the inlet opening 120 to an outer edge 124 of the shell 106. The rotation of the impeller 104 about the axis 116 draws liquid from the filter chamber 82 of the filter casing 64 into the inlet opening 120. The liquid is then forced by the rotation of the impeller 104 outward along the vanes 122. Liquid exiting the impeller 104 is advanced out of the chamber 102 through the outlet port 74 to the spray arm 54.

As shown in FIG. 4, the front end 110 of the impeller shell 106 is coupled to a rotary filter 130 positioned in the filter chamber 82 of the filter casing 64. The filter 130 has a cylindrical filter drum 132 extending from a first end 134 secured to the impeller shell 106 to a second end 136, which is axially spaced from the first end 134, rotatably coupled to a bearing 138, which is secured the main body 86 of the manifold 68. As such, the filter 130 is operable to rotate about the axis 116 with the impeller 104.

The rotating filter 130 is located within the recirculation flow path and has an upstream surface 146 and a downstream surface 148 such that the recirculating liquid passes through the rotating filter 130 from the upstream surface 146 to the downstream surface 148 to effect a filtering of the liquid. In the described flow direction, the upstream surface 146 correlates to the outer surface and that the downstream surface 148 correlates to the inner surface. If the flow direction is reversed, the downstream surface may correlate with the outer surface and that the upstream surface may correlate with the inner surface. A filter sheet 140 extends from one end 134 to the other end 136 of the filter drum 132 and encloses a hollow interior 142. The sheet 140 includes a number of passageways 144, and each hole 144 extends from the upstream surface 146 to the downstream surface 148. In the illustrative embodiment, the sheet 140 is a sheet of chemically etched metal. Each hole 144 is sized to allow for the passage of wash liquid into the hollow interior 142 and prevent the passage of soil particles.

As such, the filter sheet 140 divides the filter chamber 82 into two parts. As wash liquid and removed soil particles enter the filter chamber 82 through the inlet port 70, a mixture 150 of liquid and soil particles is collected in the filter chamber 82 in a region 152 external to the filter sheet 140. Because the passageways 144 permit liquid to pass into the hollow interior 142, a volume of filtered liquid 156 is formed in the hollow interior 142.

A flow diverter or artificial boundary 160 is positioned in the hollow interior 142 of the filter 130. The diverter 160 may be positioned adjacent to the downstream surface 148 of the sheet 140 and may be secured by a beam 174 to the housing 62. Suitable artificial flow boundaries are set forth in detail in U.S. patent application Ser. No. 12/966,420, filed Dec. 13, 2010, and titled "Rotating Filter for a Dishwashing Machine," which is incorporated herein by reference in its entirety.

Figure 5:
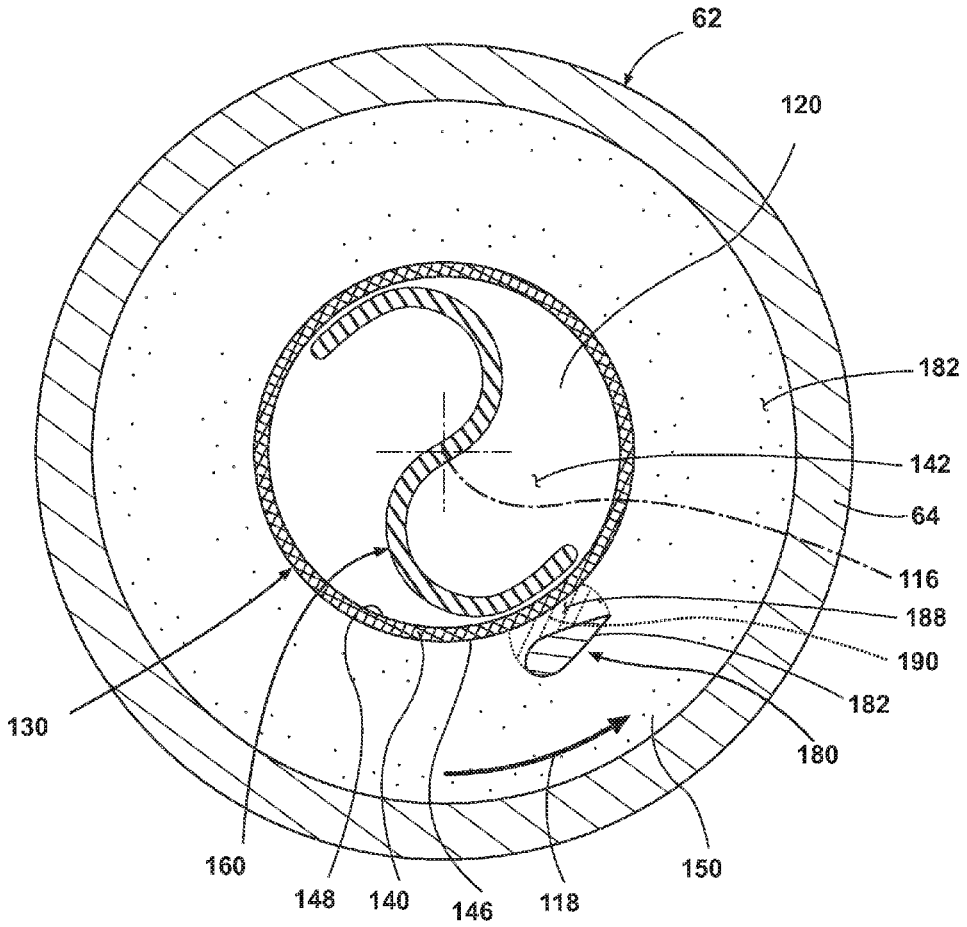
FIG. 5 is a cross-sectional view of the pump and filter assembly of FIG. 3 taken along the line 5-5 shown in FIG. 3.

Another flow diverter or artificial boundary 180 is illustrated as being positioned between the upstream surface 146 of the sheet 140 and the inner surface 84 of the housing 62. The diverter 180 has a body 182 that is spaced from at least a portion of the upstream surface 146 to form a gap therebetween and an increased shear force zone 190 (FIG. 5). The body 182 extends along the length of the filter 130 from one end 134 to the other end 136 and has a surface 183 oriented at an angle relative to the central axis 116. The artificial boundary 180 may be positioned in a partially or completely radial overlapping relationship with the artificial boundary 160 and spaced apart from the artificial boundary 180. The sheet 140 is positioned within the gap 188. In some cases, the shear zone benefit may be created with the artificial boundaries being in proximity to each other and not radially overlapping to any extent. The artificial boundaries 160 and 180 may have complimentary shapes or cross-sections, which act to enhance the shear force benefit.

It is contemplated that the artificial boundaries may be fixed relative to the filter, as illustrated, or that they may move relative to the filter. Suitable mechanisms for moving the artificial boundary 160 and/or the artificial boundary 180 are set forth in detail in U.S. patent application Ser. No. 13/108,026, filed May 16, 2011, and titled "Dishwasher with Filter Assembly," which is incorporated herein by reference in its entirety.

In operation, wash liquid, such as water and/or wash chemistry (i.e., water and/or detergents, enzymes, surfactants, and other cleaning or conditioning chemistry), enters the tub 12 through the hole 48 defined in the side wall 40 and flows into the sump 50 and down the hole 52 defined therein. As the filter chamber 82 fills, wash liquid passes through the passageways 144 extending through the filter sheet 140 into the hollow interior 142. After the filter chamber 82 is completely filled and the sump 50 is partially filled with wash liquid, the dishwasher 10 activates the motor 92.

Activation of the motor 92 causes the impeller 104 and the filter 130 to rotate. The rotation of the impeller 104 draws wash liquid from the filter chamber 82 through the filter sheet 140 and into the inlet opening 120 of the impeller shell 106. Liquid then advances outward along the vanes 122 of the impeller shell 106 and out of the chamber 102 through the outlet port 74 to the spray arm 54. When wash liquid is delivered to the spray arm 54, it is expelled from the spray arm 54 onto any dishes or other wares positioned in the treating chamber 14. Wash liquid removes soil particles located on the dishwares, and the mixture of wash liquid and soil particles falls onto the bottom wall 42 of the tub 12. The sloped configuration of the bottom wall 42 directs that mixture into the sump 50 and back to the filter chamber 82.

While liquid is permitted to pass through the sheet 140, the size of the passageways 144 prevents the soil particles of the mixture 152 from moving into the hollow interior 142. As a result, those soil particles accumulate on the upstream surface 146 of the sheet 140 and cover the passageways 144, thereby preventing liquid from passing into the hollow interior 142.

The rotation of the filter 130 about the axis 116 causes the unfiltered liquid or mixture 150 of liquid and soil particles within the filter chamber 82 to rotate about the axis 116 the same counter-clockwise direction. Centrifugal force urges the soil particles toward the side wall 76 as the mixture 150 rotates about the axis 116. As a portion of the liquid advances through the gap 188, its angular velocity increases relative to its previous velocity as well as relative to the portion of liquid that does not advance through the gap 188 and an increased shear force zone 190 (FIG. 5) is formed by the significant increase in angular velocity of the liquid in the relatively short distance between the first artificial boundary 180 and the rotating filter 130.

As the first artificial boundary 180 is stationary, the liquid in contact with the first artificial boundary 180 is also stationary or has no rotational speed. The liquid in contact with the upstream surface 146 has the same angular speed as the rotating filter 130, which is generally in the range of 3000 rpm, which may vary between 1000 to 5000 rpm. The speed of rotation is not limiting to the invention. The liquid in the increased shear zone 190 has an angular speed profile of zero where it is constrained at the first artificial boundary 180 to approximately 3000 rpm at the upstream surface 146, which requires substantial angular acceleration, which locally generates the increased shear forces on the upstream surface 146. Thus, the proximity of the first artificial boundary 180 to the rotating filter 130 causes an increase in the angular velocity of the liquid passing through the gap 188 and results in a shear force being applied on the upstream surface 146.

This applied shear force aids in the removal of soils on the upstream surface 146 and is attributable to the interaction of the liquid and the rotating filter 130. The increased shear zone 190 functions to remove and/or prevent soils from being trapped on the upstream surface 146. The liquid passing between the first artificial boundary 180 and the rotating filter 130 applies a greater shear force on the upstream surface 146 than liquid in an absence of the first artificial boundary 180. Further, an increase in shear force may occur on the downstream surface 148 where the artificial boundary 160 overlies the downstream surface 148. The liquid would have an angular speed profile of zero at the artificial boundary 160 and would increase to approximately 3000 rpm at the downstream surface 148, which generates the increased shear forces.

Figure 6:
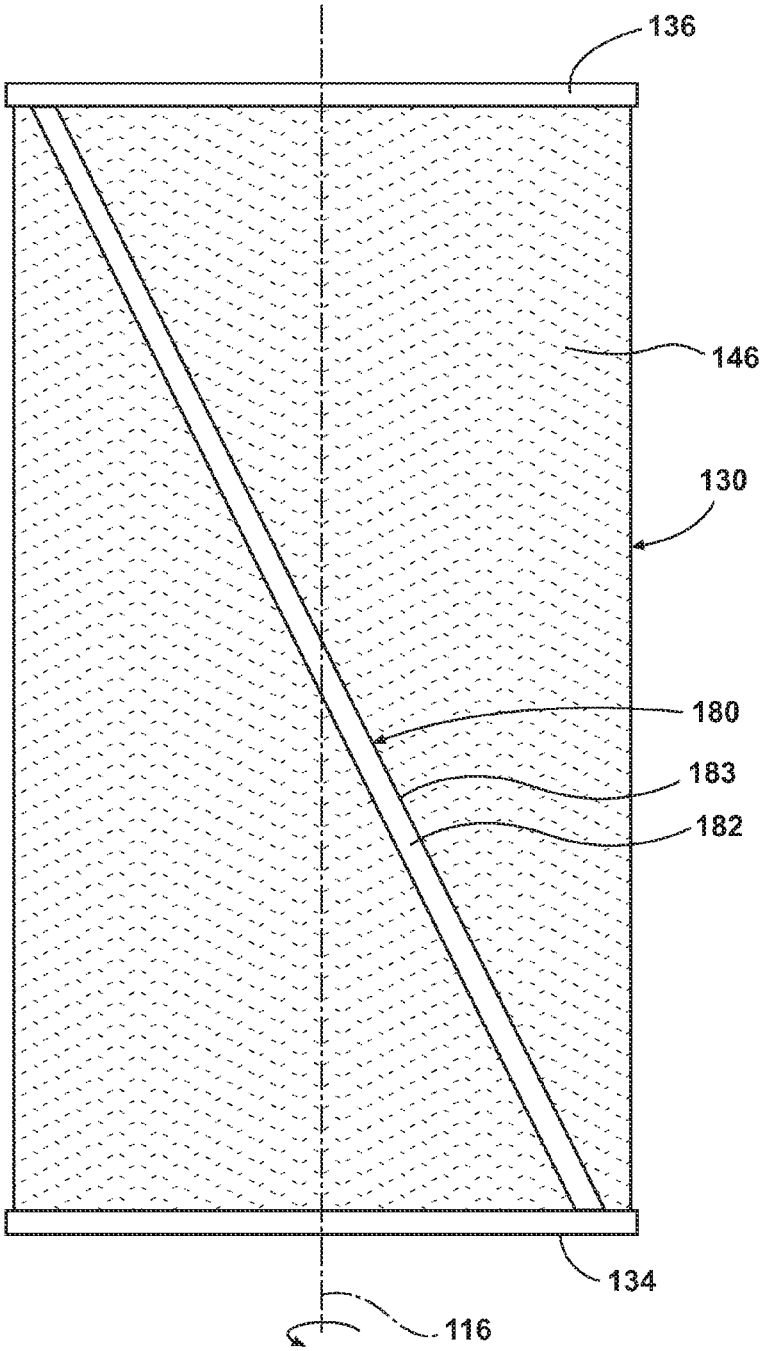
FIG. 6 is a schematic top view of a filter and artificial boundary illustrated in the pump and filter assembly of FIG. 4.

In addition to removing soils from the upstream surface 146, the configuration of the artificial boundary 180 and its surface 183, which is oriented at an angle relative to the axis 116, acts to deflect soils near the upstream surface 146 toward one of the first and second ends 134, 136. The end which the soils may accumulate at may depend on the rotational direction of the filter 130 and the angle of orientation of the artificial boundary 180. FIG. 6 illustrates a top view of the filter 130 and artificial boundary 180 and more clearly illustrates that the artificial boundary 180 has a surface 183, which is oriented at an angle relative to the axis 116 and is linear from the first end 134 to the second end 136. During operation, soils will naturally come in contact with the artificial boundary 180 as the liquid with soils in the filter chamber 82 rotate about the filter chamber 82. Further, soils that may have been removed from the filter 130 by the shear forces created by the artificial boundary 180 may also come in contact with the artificial boundary 180 after removal because centrifugal force will urge the soils away from the filter 130 towards the housing 62. Soils in contact with the surface 183 will be deflected along the surface 183 towards the second end 136 because a portion of the rotating water flow caused by the rotating water will contact the surface 183 and flow along the angled orientation of the surface 183. The soils will be drawn along the surface 183 towards the end 136 where the soils may then accumulate. Essentially, the configuration of the artificial boundary 180 encourages a movement of soils to the end 136. The drain outlet 72 is located near the end 136 such that soil which has accumulated at the end 136 may be easily pumped out of the housing 62.

It should be noted that while the filter 130 has been described as rotating in the counter-clockwise direction and the artificial boundary 180 has been described as herding soils to the end 136 it may be understood that the assembly may be configured to have the filter rotate in a clockwise direction with the impeller or have the artificial boundary 180 oriented to direct the soils to the first end 134. Regardless of which end the soils are herded towards, the drain outlet 72 may be located near the end the soils accumulate at for ease of removal of the soils from the filter chamber 82.

Figure 7:
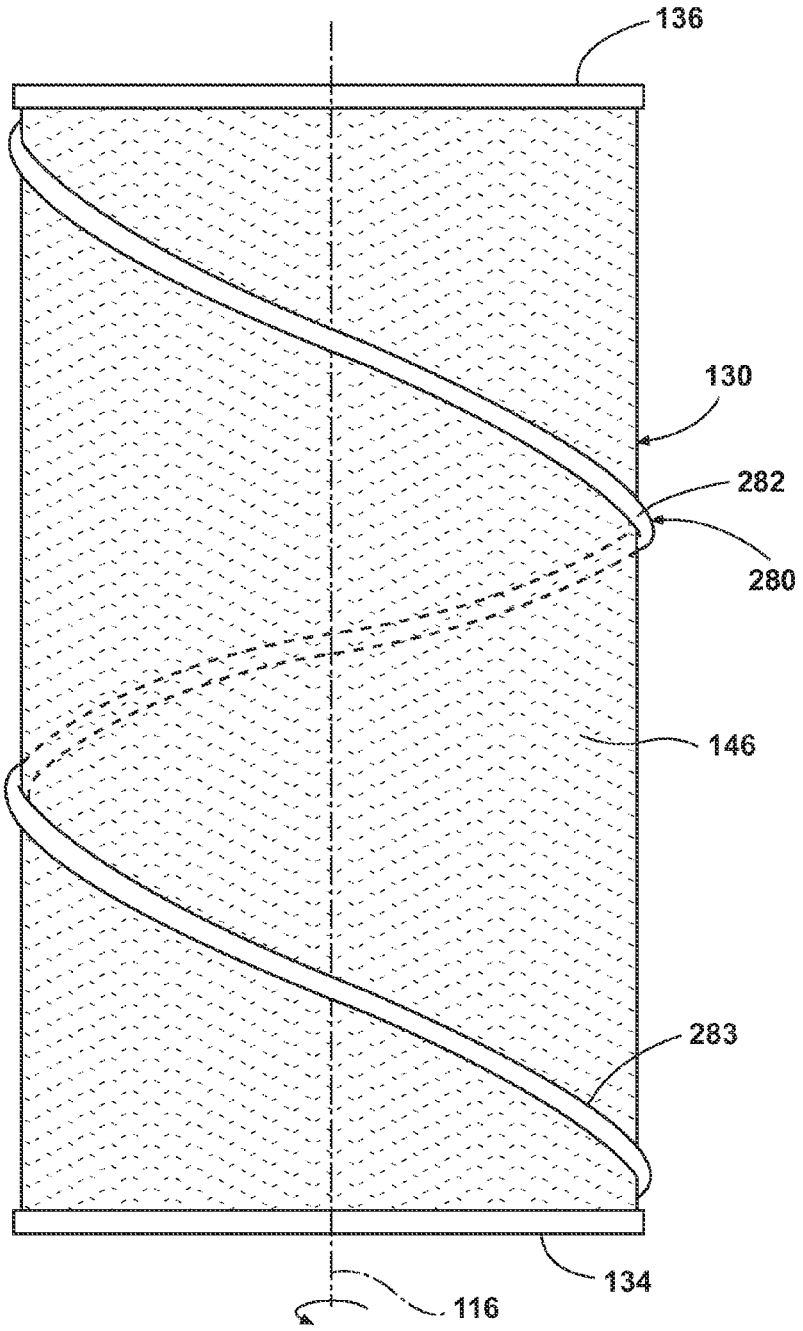
FIG. 7 is a schematic top view of a filter and artificial boundary, which may be used in the pump and filter assembly of FIG. 3 according to a second embodiment.

FIG. 7 illustrates a top view of an alternative artificial boundary 280 according to a second embodiment. The alternative artificial boundary 280 also has a surface 283 which is oriented at an angle relative to the axis 116 and may act to deflect soils near the upstream surface 146 toward one of the first and second ends 134, 136 where the soils may then accumulate at that end. The difference between the first embodiment and the second embodiment is that the surface of the artificial boundary 280 is helical instead of linear. It is contemplated that the artificial boundaries may have other alternative shapes so long as the surface is oriented at an angle relative to the central axis 116 such that soils near the upstream surface are deflected toward one of the first and second ends 134, 136. Further, the internal artificial boundaries may have complimentary shapes or cross-sections, which may act to enhance the shear force benefit. The second embodiment operates much the same way as the first embodiment. That is, the rotation of the filter 130 about the axis 116 causes the liquid and soil particles to rotate about the axis 116. Centrifugal forces push the liquid and soils towards the outside and soils which come in contact with the surface 283 are deflected by force vectors towards the end 136.

Figure 8:
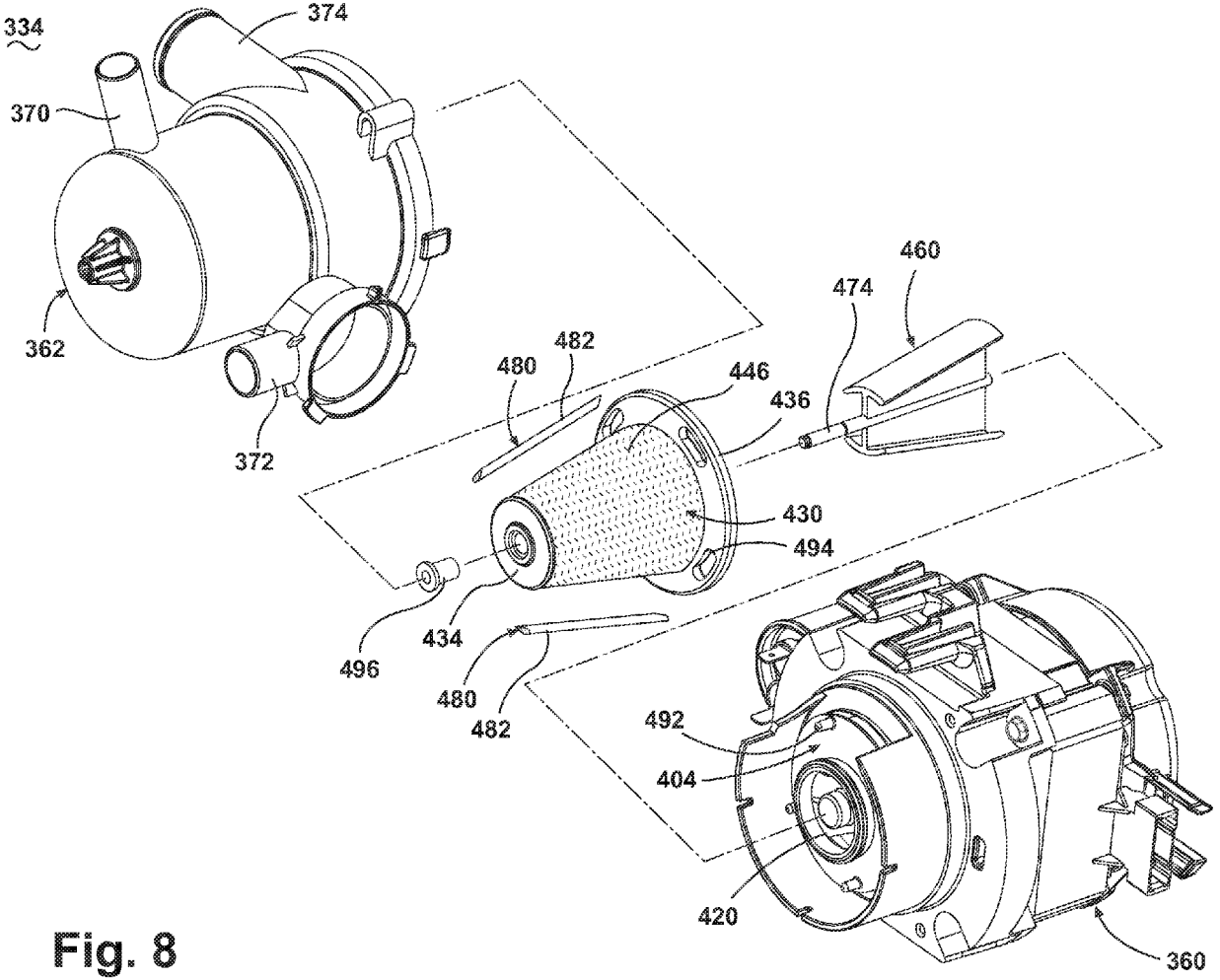
FIG. 8 is an exploded view of a third embodiment of a pump and filter assembly, which may be used in the dishwashing machine of FIG. 1.
Figure 9:
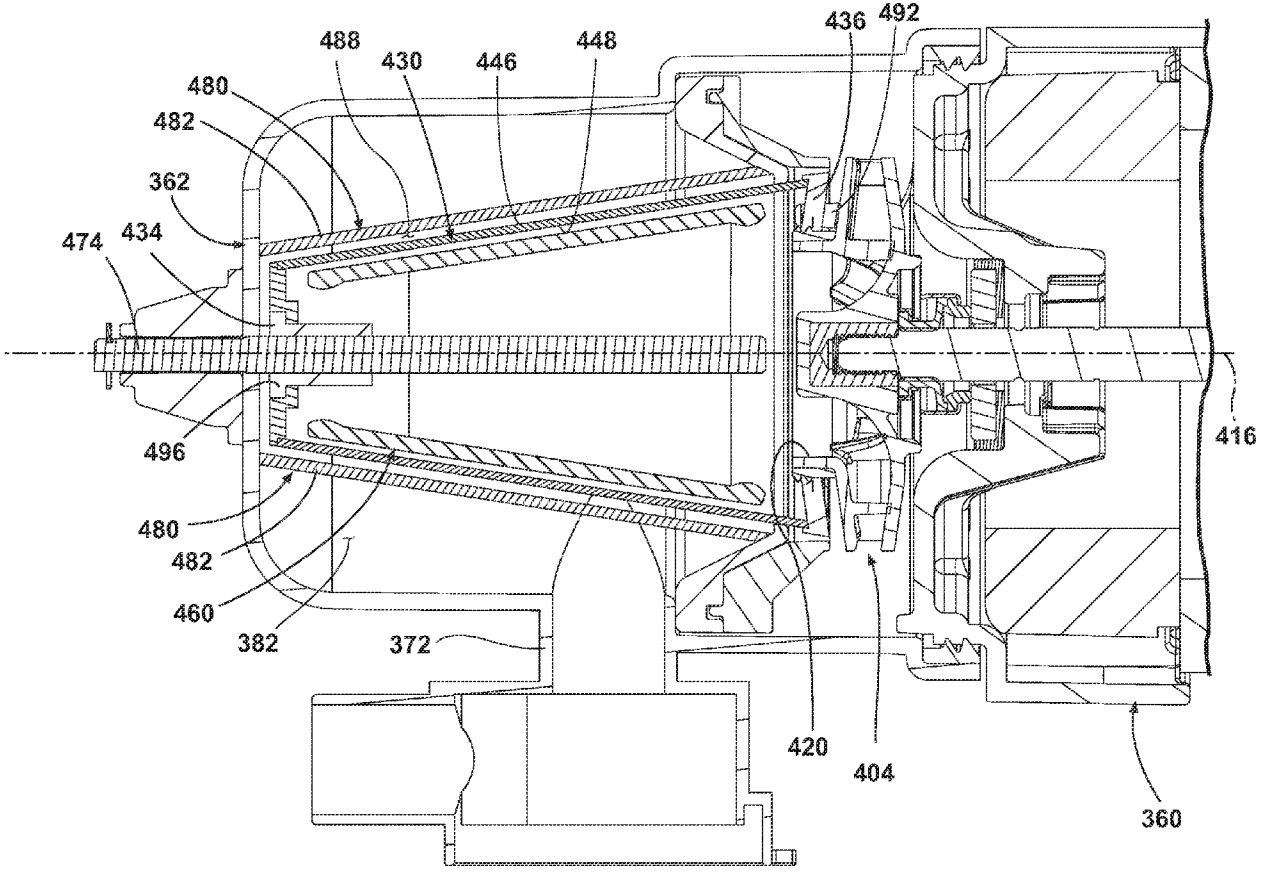
FIG. 9 is a cross-sectional view of the assembled pump and filter assembly of FIG. 8.

FIGS. 8 and 9 illustrate an alternative pump and filter assembly according to a third embodiment. The third embodiment is similar in some aspects to the first embodiment; therefore, like parts will be identified with like numerals increased by 300, with it being understood that the description of the like parts of the first embodiment applies to the third embodiment, unless otherwise noted.

The pump and filter assembly 334 includes a modified filter casing or filter housing 362, a wash or recirculation pump 360, a rotating filter 430, internal artificial boundaries 460, and external artificial boundaries 480. The filter housing 362 defines a filter chamber 382 that extends the length of the filter casing 362 and includes an inlet port 370, a drain outlet port 372, and a recirculation outlet port 374. It is contemplated that the drain outlet port 372 may be formed directly in the housing 362 and may be fluidly coupled to a drain pump (not shown) to drain liquid and soils from the dishwasher 10. The recirculation pump 360 also includes an impeller 304, which has several pins 492 that may be received within openings 494 in the end 436 of the filter 430 such that the filter 430 may be operably coupled to the impeller 304 such that rotation of the impeller 304 effects the rotation of the filter 430.

The rotating filter 430 is similar to that of the first embodiment except that it has a first end 434 axially spaced from a second end 436 that is larger in diameter than the first end 434. This forms a cone-shaped filter 430 that has a central axis corresponding to the rotational axis 316. A cone shaped filter sheet may extend between the two ends 434 and 436 and may have an upstream surface 446 correlating to the outer surface and a downstream surface 448 correlating to the inner surface as described with respect to the above embodiment. A bearing 496 may be used to rotatably mount the first end 434 of the filter 430 to the housing 362 such that the filter 430 is free to rotate in the bearing 496 about the axis 316 in response to rotation of the impeller 304.

The internal artificial boundary 460 may be located internally of the filter 430 and may be positioned adjacent to the downstream surface 448 and may be secured by a shaft 474 to the housing 362. Suitable artificial flow boundaries are set forth in detail in U.S. patent application Ser. No. 12/966,420, filed Dec. 13, 2010, and titled "Rotating Filter for a Dishwashing Machine," which is incorporated herein by reference in its entirety. The bearing 496 may rotatably receive the stationary shaft 474, which in turn is mounted to the artificial boundary 460. Thus, the artificial boundary 460 may be stationary while the filter 430 is free to rotate. Further, an increase in shear force may occur on the downstream surface 448 where the artificial boundary 460 overlies the downstream surface 448. The liquid would have an angular speed profile of zero at the artificial boundary 460 and would increase to approximately 3000 rpm at the downstream surface 448, which generates the increased shear forces.

The artificial boundaries 480 may be located such that they are overlying and spaced from at least a portion of the upstream surface 446 to form an increased shear force zone as described with respect to the first embodiment. The artificial boundaries 480 apply a greater shear force on the upstream surface 446 than liquid in an absence of the first artificial boundary. The artificial boundaries 480 may be mounted to the housing 362. The artificial boundary 480 may be positioned in a partially or completely radial overlapping relationship with the artificial boundary 460 and spaced apart from the artificial boundary 480. In some cases, the shear zone benefit may be created with the artificial boundaries being in proximity to each other and not radially overlapping to any extent.

It is contemplated that the artificial boundaries 460 and 480 may be fixed relative to the filter 430, as illustrated, or that they may move relative to the filter 430. Suitable mechanisms for moving the artificial boundary 460 and/or the artificial boundary 480 are set forth in detail in U.S. patent application Ser. No. 13/108,026, filed May 16, 2011, and titled "Dishwasher with Filter Assembly," which is incorporated herein by reference in its entirety.

The third embodiment operates much the same as the above described first embodiment in that when the impeller 304 is rotated the filter 430 is also rotated. The rotation of the impeller 304 draws liquid from the filter chamber 382 into the inlet opening of the impeller 304. The liquid is then forced out through the recirculation outlet port 374 to the spray system. The recirculation pump 360 is fluidly coupled downstream of the downstream surface 448 of the filter 430 at the second end 436 and if the recirculation pump 360 is shut off then any liquid not expelled will settle in the filter chamber 382 and may be drained by the drain pump through the drain outlet port 372.

Figure 10:
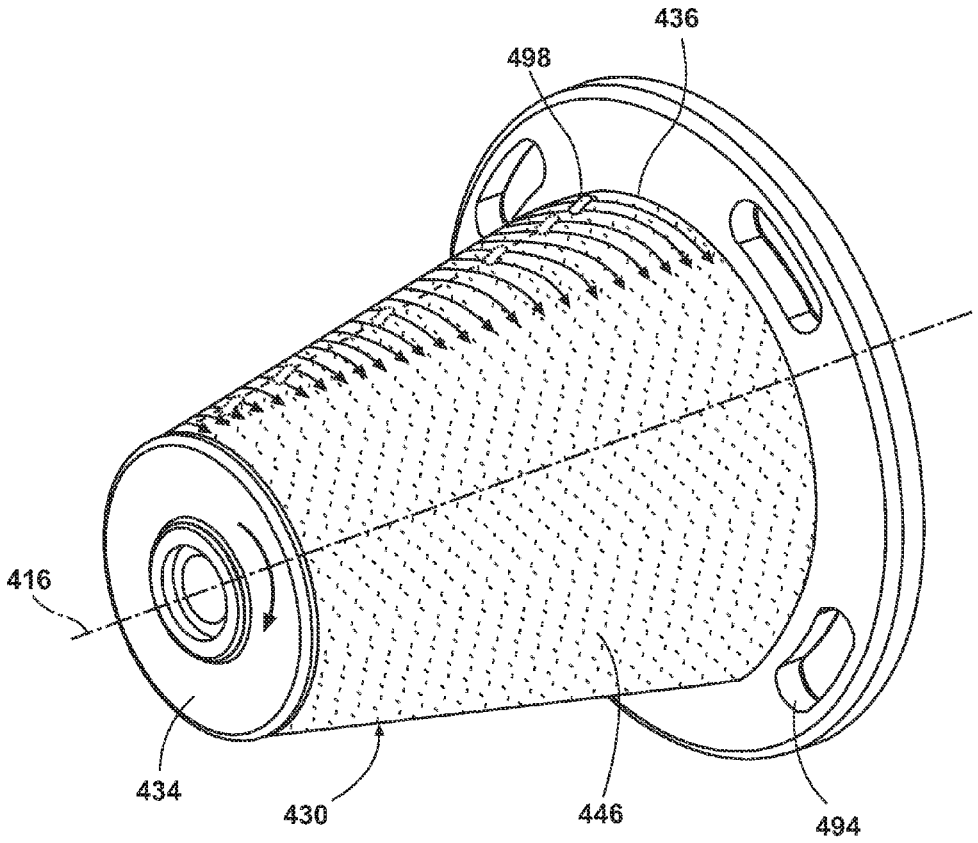
FIG. 10 is a schematic perspective view of a filter and artificial boundary illustrated in FIG. 8.

One main difference in the operation is that the rotation of the cone filter 430 generates a soil flow from the first end 434 to the second end 436. That is, soil 498 which is filtered from the liquid and residing on the upstream surface 446 is urged by the soil flow toward the second end 436, even without the use of the first artificial boundary 480, because of a flow path that develops from the first end 434 to the second end 436. It will be understood that the filter 430 as a whole is rotated by the impeller 304 at a single rotational speed. Thus, all points on the filter 430 have the same rotational speed. However, because the diameter of the cone filter continuously increases from the first end 434 to the larger diameter second end 436, the tangential velocity (illustrated by the arrows on FIG. 10) increases axially from the first end 434 to the second end 436 for any point on the upstream surface 446. The increase in the tangential velocity necessarily requires a corresponding increase in the tangential acceleration. As such, the tangential acceleration increases from the first end 434 to the second end 436, which creates a soil flow from the first end 434 to the second end 436 when the acceleration rate is great enough to overcome other forces, such as gravity acting on the suspended soils, which would tend to draw the soils down toward the small end 434 for a horizontally oriented filter as illustrated. For the contemplated rotational speed range (1000 rpm to 5000 rpm) for the illustrated cone filter 430, the resulting tangential acceleration is great enough to form the soil flow from the first end 434 to the second end 436. Therefore, rotation of the cone filter 430 alone is sufficient to move the soils toward one end, the large end 436, of the filter 430, when the filter 430 is rotated at a high enough speed.

Figure 11:
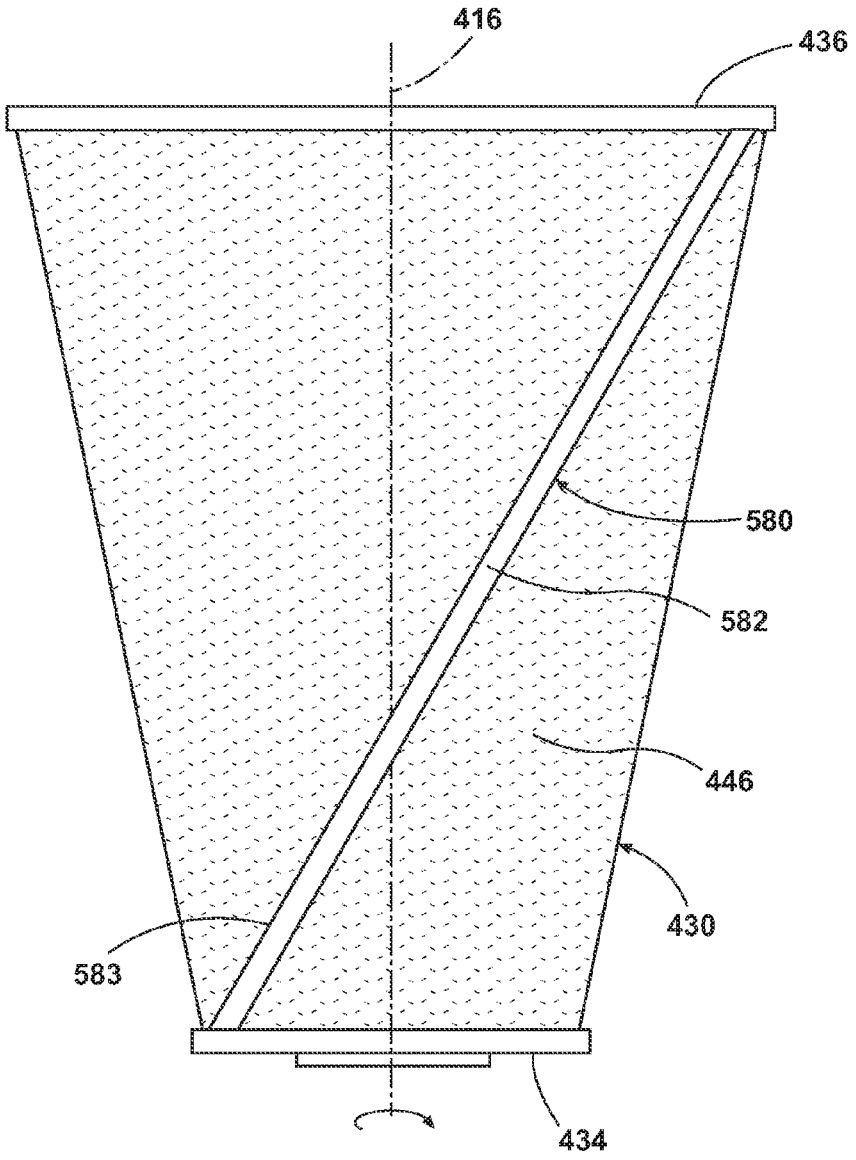
FIG. 11 is a schematic top view of a filter and artificial boundary, which may be used in the pump and filter assembly of FIG. 8 according to a fourth embodiment.

FIG. 11 illustrates a top view of an alternative artificial boundary 580 according to a fourth embodiment, which may be used with the cone-filter 430 described above. The artificial boundary 580, much like the first embodiment, has a linear surface 583 which is oriented at an angle relative to the axis 416 and may act to deflect soils near the upstream surface 446 toward the second end 436 where the soils may then accumulate at that end. The difference between the third embodiment and the fourth embodiment is that the orientation of the surface 583 of the artificial boundary 580 acts to deflect the soils towards the end 436 along with the soil flow already created by the cone shape filter 430 itself, which also directs the soils towards the second end 436. Thus, the shape of the rotating filter 430 and the surface 583 being oriented at an angle relative to the central axis 416 both act together to deflect soils towards the second end 436.

Figure 12:
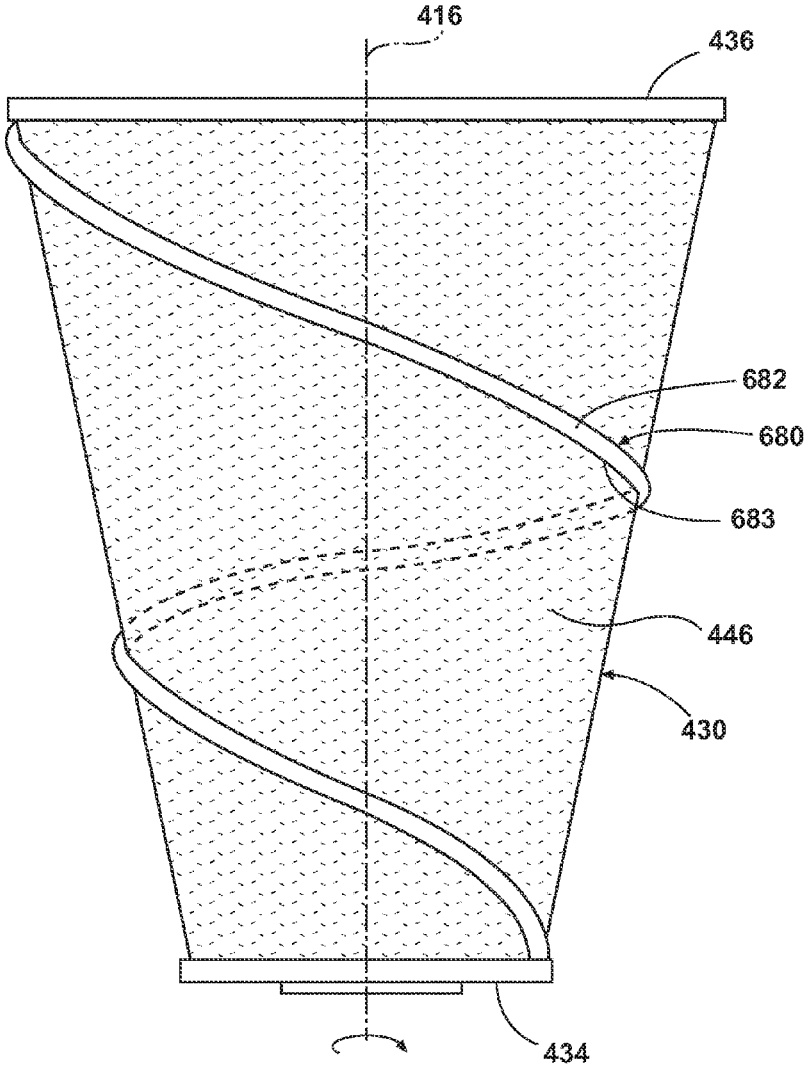
FIG. 12 is a schematic top view of a filter and artificial boundary, which may be used in the pump and filter assembly of FIG. 8 according to a fifth embodiment.

FIG. 12 illustrates a top view of an alternative artificial boundary 680 according to a fifth embodiment. Much like the fourth embodiment, the artificial boundary 680 has a surface 683 which is oriented at an angle relative to the axis 416 and may act to deflect soils near the upstream surface 446 toward the second end 436 where the soils may then accumulate at that end. The difference between the fourth embodiment and the fifth embodiment is that the surface 683 of the artificial boundary 680 is helical instead of linear. It too acts together with the soil flow created by the cone shaped filter 430 to deflect soils towards the second end 436.

It is contemplated that the artificial boundary or artificial boundaries may have other alternative shapes so long as the surface is oriented at an angle relative to the central axis of the filter such that soils near the upstream surface are deflected toward one of the first and second ends. It likely goes without saying, but aspects of the various embodiments may be combined in any desired manner to accomplish a desired utility. By way of non-limiting example, various aspects of the first embodiment may be combined with the later embodiments as desired to accomplish the inclusion of internal artificial boundaries and to effect rotation of either or both of the artificial boundaries relative to the filter.

There are a plurality of advantages of the present disclosure arising from the various features of the method, apparatuses, and system described herein. For example, the embodiments of the apparatus described above allows for enhanced filtration such that soil is filtered from the liquid and not redeposited on utensils. Further, the embodiments of the apparatus described above allow for cleaning of the filter throughout the life of the dishwasher and this maximizes the performance of the dishwasher. Thus, such embodiments require less user maintenance than required by typical dishwashers.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An automatic dishwasher for washing utensils according to a cycle of operation, comprising:

a tub at least partially defining a treating chamber;

a liquid spraying system supplying a spray of liquid to the treating chamber;

a liquid recirculation system fluidly coupling the treating chamber to the liquid spraying system and defining a recirculation flow path for recirculating the sprayed liquid from the treating chamber to the liquid spraying system; and a liquid filtering system fluidly coupled to the recirculation flow path and comprising:

a filter chamber;

a rotating filter located within the filter chamber and having a first end axially spaced from a second end, larger in diameter than the first end, and defining a cone-shaped filter therebetween having a central axis and extending between the first end and the second end, the rotating filter also having an upstream surface and a downstream surface; and a first artificial boundary overlying and spaced from at least a portion of the upstream surface to form an increased shear force zone therebetween to apply a greater shear force on the upstream surface than liquid in an absence of the first artificial boundary;

wherein the rotating filter is located within the recirculation flow path such that the recirculation flow path passes through the filter from the upstream surface to the downstream surface, the rotating filter fluidly divides the filter chamber into a first part that contains filtered soil particles and a second part that excludes filtered soil particles and the rotating filter is configured to rotate such that rotation of the filter generates a soil flow in the first part from the first end to the second end whereby soil filtered from the liquid and residing on the upstream surface is urged by the soil flow toward the second end.

2. The automatic dishwasher of claim 1, further comprising a drain outlet located near the second end.

3. The automatic dishwasher of claim 2, further comprising a filter housing defining the filter chamber, with the drain outlet formed in the filter housing.

4. The automatic dishwasher of claim 3 wherein the filter housing is remote from the tub.

5. The automatic dishwasher of claim 1 wherein the first artificial boundary is fixed relative to the cone-shaped filter.

6. The automatic dishwasher of claim 1 wherein the rotating filter rotates about the central axis.

7. The automatic dishwasher of claim 6 wherein the central axis is oriented non-vertically.

8. The automatic dishwasher of claim 7 wherein the central axis is oriented substantially horizontally.

9. The automatic dishwasher of claim 6 wherein the first artificial boundary has a surface oriented at an angle relative to the central axis to deflect soils near the upstream surface toward the second end.

10. The automatic dishwasher of claim 9 wherein the surface is linear.

11. The automatic dishwasher of claim 9 wherein the surface is helical.

12. The automatic dishwasher of claim 1, further comprising a second artificial boundary overlying and spaced from at least a portion of the downstream surface to form an increased shear force zone therebetween to apply a greater shear force on the downstream surface than liquid in an absence of the second artificial boundary.

13. An automatic dishwasher for washing utensils according to a cycle of operation, comprising:

a tub at least partially defining a treating chamber;

a liquid spraying system supplying a spray of liquid to the treating chamber;

a liquid recirculation system fluidly coupling the treating chamber to the liquid spraying system and defining a recirculation flow path for recirculating the sprayed liquid from the treating chamber to the liquid spraying system; and a liquid filtering system fluidly coupled to the recirculation flow path and comprising:

a filter chamber;

a rotating filter located within the filter chamber and having first and second ends, a downstream surface and an upstream surface, and a central axis and located within the recirculation flow path such that the sprayed liquid passes through the filter from the upstream surface to the downstream surface to effect a filtering of the sprayed liquid; and a first artificial boundary overlying and spaced from at least a portion of the upstream surface to form an increased shear force zone therebetween to apply a greater shear force on the upstream surface than liquid in an absence of the first artificial boundary, and having a surface oriented at an angle relative to the central axis to deflect soils near the upstream surface toward one of the first and second ends;

wherein the rotating filter fluidly divides the filter chamber into a first part that contains filtered soil particles and a second part that excludes filtered soil particles and the rotating filter is configured to rotate while liquid is passing through along the recirculation flow path and this results in soils residing near the upstream surface and the soils are directed toward one of the first and second ends where the soils accumulate.

14. The automatic dishwasher of claim 13, further comprising a drain outlet located near one of the first and second ends.

15. The automatic dishwasher of claim 14, further comprising a filter housing defining the filter chamber, with the drain outlet formed in the filter housing.

16. The automatic dishwasher of claim 15 wherein the filter housing is remote from the tub.

17. The automatic dishwasher of claim 13 wherein the first artificial boundary is fixed relative to the filter.

18. The automatic dishwasher of claim 13 wherein the rotating filter rotates about the central axis.

19. The automatic dishwasher of claim 18 wherein the central axis is oriented non-vertically.

20. The automatic dishwasher of claim 19 wherein the central axis is oriented substantially horizontally.

21. The automatic dishwasher of claim 13 wherein the surface is linear.

22. The automatic dishwasher of claim 13 wherein the surface is helical.

23. The automatic dishwasher of claim 13, further comprising a second artificial boundary overlying and spaced from at least a portion of the downstream surface to form an increased shear force zone therebetween to apply a greater shear force on the downstream surface than liquid in an absence of the second artificial boundary.

* * * * *